United States Patent [19]

Baubles

[11] Patent Number: 5,069,637

[45] Date of Patent: Dec. 3, 1991

[54] INSULATION DISPLACING ELECTRICAL CONNECTOR

[75] Inventor: Richard C. Baubles, Maplewood, N.J.

[73] Assignee: Jacobson Mfg. Co., Inc., Kenilworth, N.J.

[21] Appl. No.: 715,466

[22] Filed: Jun. 14, 1991

[51] Int. Cl.[5] ..... H01R 4/24

[52] U.S. Cl. ..... 439/412

[58] Field of Search ..... 439/389–425

[56] References Cited

U.S. PATENT DOCUMENTS

| | | | |
|---|---|---|---|
| 3,512,120 | 5/1970 | Bean | 439/412 |
| 3,768,067 | 10/1973 | Rault | 439/412 |
| 4,652,071 | 3/1987 | Debortoli et al. | 439/412 |
| 4,911,655 | 3/1990 | Pinyan et al. | 439/412 |

*Primary Examiner*—Joseph H. McGlynn

*Attorney, Agent, or Firm*—Richard L. Cannaday; Frank J. DeRosa

[57] ABSTRACT

An electrical connector is disclosed which makes connection to one or more unstripped insulated conductors. The connector includes a movable contact assembly disposed in a cavity for movement between open and closed positions. The connector includes a fixed contact electrically coupled to a contact of the movable contact assembly at least in the closed position of the movable contact assembly. The cavity is sealed except for one or more inlets through which one or more conductors are inserted into the cavity for connection. The cavity receives a water-proofing or sealing compound. The connector is constructed so that the cavity volume is constant in both the open and closed positions and during travel of the movable contact assembly. Thereby, compound is not forced out of the cavity when a conductor is connected or disconnected, i.e., when the movable contact assembly is moved. An activator for moving the movable contact assembly is insulated from the contacts of the connector at all times. The connector may connect each conductor of a communication pair of either a two-conductor drop line or two single conductor lines to a different fixed contact of the connector. Connection of the two conductors of the pair to the connector is made at the same time. The connector is constructed to accommodate a range of insulated conductor sizes. A connector assembly may comprise a plurality of connectors in a common housing.

35 Claims, 6 Drawing Sheets

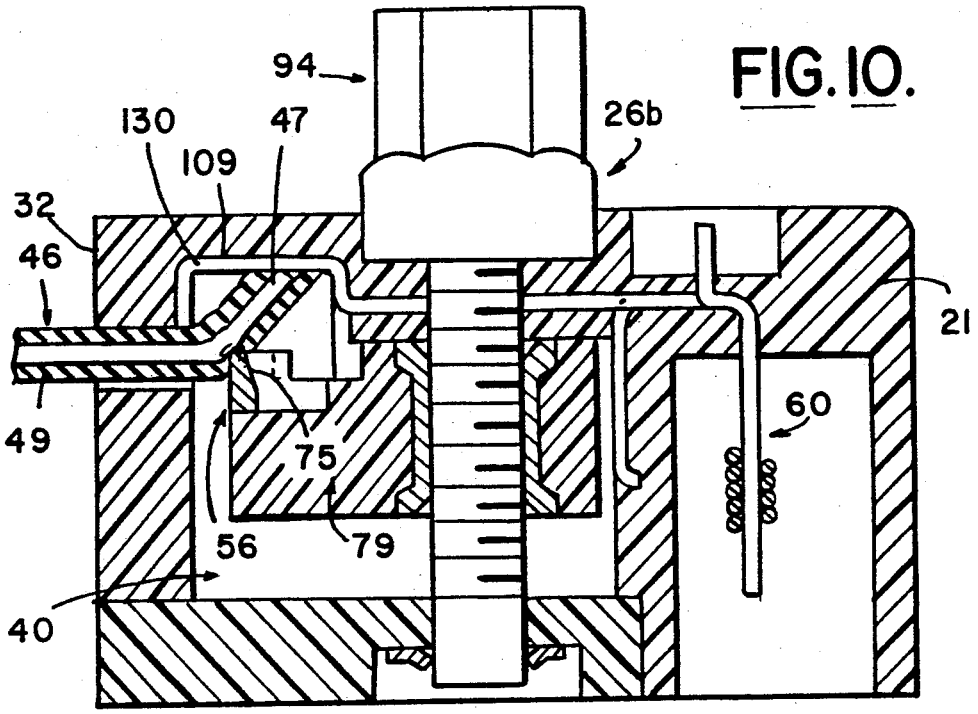
FIG. 10.
FIG. 11.
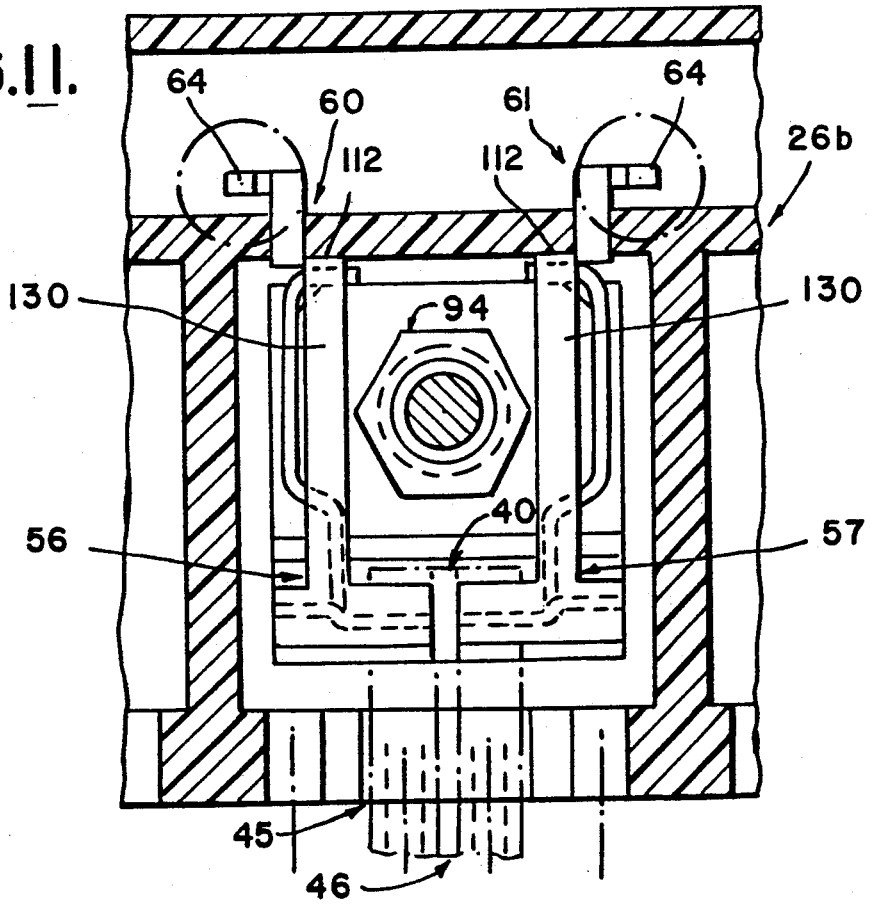

INSULATION DISPLACING ELECTRICAL CONNECTOR

BACKGROUND OF THE INVENTION

The invention disclosed herein relates to an electrical connector for making electrical connection to at least one electrical conductor, particularly for connecting a conductor without stripping the insulation therefrom, and especially as used for telecommunications applications.

There are many different terminal blocks currently available for use in the telecommunications field, each aiming to fill a specific need. Most, however, are relatively old and are labor intensive to install and maintain. They also suffer from a variable signal quality as they are open to the elements and corrosion build-up degrades the signal.

In typical usage in telecommunications applications, a telephone distribution cable is permanently attached to a terminal block at manufacture and spliced into the telecommunications system at installation. The connections to the terminal block vary from 26 gage vinyl insulated copper wire to rubber insulated copper coated hard steel "drop wire" or "drop line" that runs from a pole or pedestal to the house connection. (A typical drop wire has a pair of conductors in a single jacket linked like electrical lamp cord.)

A current terminal block is disclosed in Debruycker U.S. Pat. No. 4,846,721. Such a terminal block, and blocks based on it, have several disadvantages. They cannot accept a drop wire "pair" without the installer first splitting the two conductors. Also, because of the method of connection and the materials used, the hard steel drop wire frequently deforms the contacts in the terminal block upon tightening. While such blocks maintain good contact with the initial connection, they are not capable of then making connection to a lighter gage conductor.

In order to maintain a waterproof connection, the joint in connectors of terminal blocks may be protected by a water resistant compound, such as a gel or grease. In conventional connectors, the connection actuator acts like a tight fitting piston in a cylinder so that as the connection is made tighter the available volume in the cylinder is decreased. As the gel or grease is not compressible, an escape relief is provided for the excess material. That means that the material must move almost completely out of the initial cylinder into the relief area and still be able to return when the connection is loosened. This is very difficult for a grease to accomplish so that gels are required.

Most of the terminal blocks currently available employ either screws with washers or studs with nuts and washers to make removable outside connections. In either case, the insulated connector must be stripped and then is tightened between the washers to make the connection. These connections can accommodate a large range of wire sizes and make good electrical contact consistently. However they do require preparation of the wire and are very difficult to protect from atmospheric corrosion.

Connections may also be made without stripping insulation from the conductors. Many connectors which require and connect unstripped conductors displace the insulation to make electrical connection to the conductor.

There are two general classes of such insulation displacement connectors. In one type, the connector includes a blade with a tapered slot. The wire is pushed into the slot and the edges of the slot pierce the insulation and make contact with the conductor. This type is widely used for inside connections when the conductor size range is very narrow. The disadvantages are the inability to handle more than one or two conductor gage sizes and the lack of atmospheric protection. In many areas of the country this type of connector is no longer used because of problems with corrosion attacking the electrical contact locations. The second type connector uses a special capped nut that fits over a threaded stud with a cross hole for the conductors. A single conductor is inserted into the cross hole and the cap tightened to a stop. The conductor is pinched between the edge of the cross hole and the edge of the cap making electrical contact through the insulation. The entire mechanism is buried inside the terminal block and protected with a waterproof grease or gel. To fit the full range of wire sizes it is necessary to maintain very tight dimensional control of the components which make those terminals expensive. They do work however and in Applicant's estimation are the best terminal blocks now on the market. They have disadvantages in that they are inherently expensive, in that the drop lines or conductors usually manufactured as joined pairs must be separated, but not stripped, before being terminated, and that only one conductor can be terminated at a time.

OBJECTS OF THE INVENTION

It is an object of the invention disclosed herein to provide an improved connector for unstripped insulated electrical conductors.

It is an object of the invention to provide a terminal block that is easy to use, thereby to save time, work and cost.

It is another object of the invention to provide a connector for electrical conductors that has improved resistivity and/or tolerance to adverse environmental conditions such as high moisture, salt water, wide temperature variations, etc.

It is another object of the invention to provide a terminal block weather protected to the extent that it will operate even when submerged in water.

It is another object of the invention to provide a connector which receives a sealing or waterproofing compound for insulating an electrical connection made by the connector from the environment, and which retains that compound without replenishment for multiple connect/disconnect cycles of the electrical connection.

It is an object of the invention to provide a connector in which the grease or gel is not displaced out of the joint area when the connection is tightened.

It is another object of the invention to provide a connector which may employ a wide variety of sealing materials including greases and gels.

It is another object of the invention to provide a connector which may connect an increased number of telecommunication conductors thereto, e.g., three pairs of conductors.

It is another object of the invention to provide a connector which makes repeated connections with varying size conductors without difficulty.

It is another object of the invention to provide a connector which may accommodate insulated conductors of varying diameters within a given range.

It is another object of the invention to provide a connector for electrical connectors that makes electrical contact to a pair of electrical conductors at the same time using a single actuator.

It is another object of the invention to provide a connector which permits connection to both pairs of a drop wire without first splitting the wire, thereby to save time, work and cost.

It is another object of the invention to provide a connector which may connect a pair of closely spaced conductors held within a common insulating package, e.g., telecommunication drop lines, as well as individual separated insulated conductors.

It is another object of the invention to provide a connector in which the actuator for making electrical connection between a conductor and the connector is insulated from the electrical contacts of the connector and from a connected conductor.

It is another object of the invention to provide a connector of the type described in any of the above objects of the invention which includes a test prong arranged to provide a so-called quiet front feature.

It is another object of the invention to provide a connector of the type described in any of the above objects of the invention that may be manufactured relatively easily and/or inexpensively.

It is another object of the invention to provide a connector of the type described in any of the above objects of the invention that may be manufactured to a large extent by molding processes.

It is another object of the invention to provide a connector of the type described in any of the above objects of the invention which incorporates a number of connectors into a common molded housing.

It is another object of the invention to provide a terminal block incorporating a plurality of connectors of the type referred to in any of the above objects of the invention.

SUMMARY OF THE INVENTION

The invention disclosed herein achieves various combinations of the above and other objects.

An electrical connector according to the invention comprises a housing in which electrical connection is made between one or more conductors inserted into the housing and one or more contacts. Movable contact means including at least one first contact are disposed in the housing movable between an open position in which a conductor may be inserted into the housing adjacent the first contact and a closed position in which the first contact makes electrical contact with the conductor adjacent thereto. A second (fixed) contact is coupled to the first contact at least in the closed position of the movable contact means. In a preferred embodiment, the first contact is itself movable.

In preferred embodiments, the connector causes an electrical connection to be made between an insulated conductor and the first contact when the movable contact means are moved to the closed position.

In a preferred embodiment, the movable contact means comprises a movable element which carries the first (movable) contact and is movable between the open position and the closed position. Means actuable from the exterior of the housing are provided for moving the movable contact mean (and/or the first contact thereof) between the open and closed positions, whereby an electrical connection may be made between a conductor inserted into the housing and the second contact.

The actuable means includes a member which is engaged by a user to move the movable contact means and/or the first contact thereof. That member is electrically isolated or insulated from the first and second contacts at all times.

The second contact includes means by which electrical connection thereof may be made, for example, to another conductor, to a circuit point, or the like. In a preferred embodiment, the second contact includes a wire wrap post to which a conductor may be connected by being wrapped thereto. Also, in a preferred embodiment, a test prong is coupled to the fixed contact. The test prong is recessed with respect to the housing so it does not protrude therefrom. Thus, accidental contacting of the test prong is avoided and the so-called quiet front feature is provided.

In one embodiment, the movable contact means bends the conductor as the movable contact means are moved from the open to the closed position such that the first contact tangentially contacts the conductor. In that embodiment, space is provided in the housing adjacent the first contact to accommodate conductors having a size within a given range of sizes encompassing conductors of at least two gages. A conductor of a size within the range may then be moved within the space by the movable contact means when the movable contact means are moved from the open to the closed position. Movement of the conductor within the space enables conductors having a size within the range to be engaged by the first contact without the contact cutting substantially into the conductor and without damaging the conductor. In another embodiment, little or no bending of the conductor takes place and the first contact cuts into the conductor at a right angle or at a large acute angle.

In a preferred embodiment, the housing defines a cavity which is closed except for one or more inlets thereto through the housing. That cavity may receive a waterproofing or sealing compound which is substantially in liquid form at least at the time of introduction thereof into the cavity, i.e. a high viscosity liquid such as silicone grease. The second contact includes a portion outside of the cavity for connection to the conductor or circuit element. The movable contact means and the cavity are configured to provide a constant cavity volume during movement of the movable contact means between the open and closed positions such that compound in the cavity is substantially not displaced from the cavity by movement of the movable contact means. In that way, compound in the cavity will not be expelled during connect and disconnect cycles, and the cavity does not have to be recharged with compound after each connect or disconnect cycle.

A connector according to the invention may connect a pair of closely spaced conductors held within a common insulating package, e.g., telecommunication drop lines, as well as individual separated insulated conductors. A connector according to an embodiment of the invention has at least one inlet to the housing (or cavity) through which a plurality of electrical conductors may be introduced into the housing (or cavity), and a plurality of first contacts and a plurality of second contacts. For example, the connector may include two first contacts and two second contacts arranged so that the connector may connect either or both a pair of separate conductors of a communication pair or two conductors held by a common insulating package, e.g., two conductors of a drop line. In a preferred embodiment, the connector makes contact with each conductor of a communication pair at the same time upon actuation of a common actuating means. Also in the preferred embodiment, the connector connects up to three pairs of conductors, e.g., the two conductors of a drop line pair and two pairs of separated conductors.

According to the invention a plurality of connectors may be commonly housed. Such connectors may be generally modular in that each includes its own movable contact means disposed isolated within a common housing. In a preferred embodiment, the common housing forms with a common bottom closure a plurality of cavities, in each of which is disposed a movable contact means.

BRIEF DESCRIPTION OF THE DRAWINGS

The invention is illustrated by way of example and not limitation in the figures of the accompanying drawings in which like references denote the same or corresponding parts, and in which:

FIG. 10 is a side view similar to that of FIG. 4 of a connector assembly according to another embodiment of the invention;

FIG. 11 is a section view similar to that of FIG. 6 of the connector assembly of FIG. 10.

DESCRIPTION OF THE PREFERRED EMBODIMENTS

Figure 7:
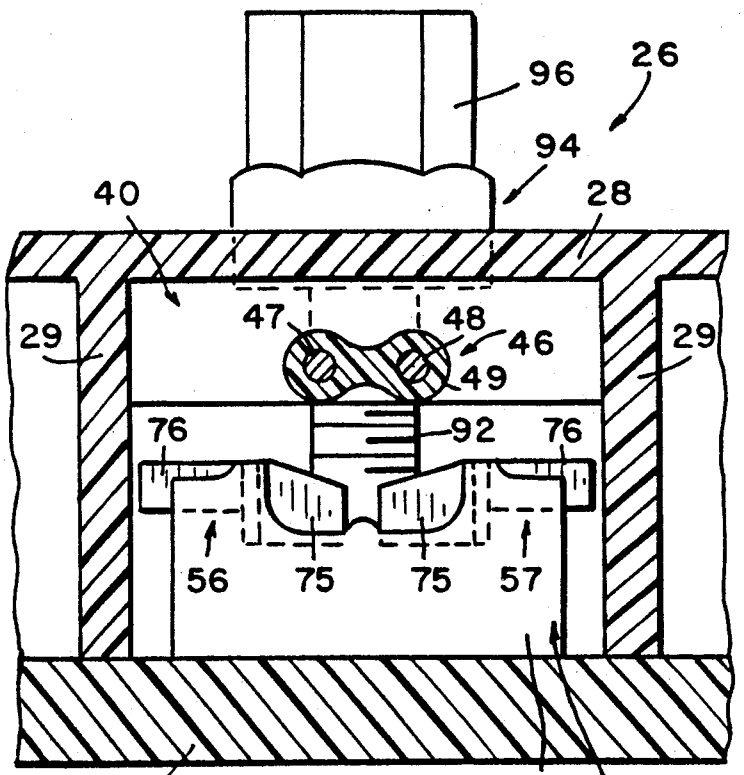
FIG. 7 is a section view of the connector assembly of FIG. 1 taken along line 7—7 in FIG. 4, showing the open position of the movable contact.

Referring to FIGS. 1-7, connector assembly 20 (FIGS. 1-3) according to the invention comprises a common housing 21 for five connectors 22-26. Housing 21 comprises a top 28, spaced interior partitions 29 (FIGS. 6 and 7) depending from top 28, sides 30, a front 32, a rear 34 and a bottom 36 which is closed in the front portion thereof by a one-piece closure 38 secured to housing bottom 36 by an adhesive. Housing top 28, respective partitions 29, respective sides 30 and closure 34 define for each connector 22-26 a cavity 40 (FIG. 7). The use of a separate bottom closure 38 allows housing 21 to be molded with the complex large internal cavities 40 for each connector 22-26 and a cavity or deep recess 70 (FIGS. 3-5) in the bottom 36 of housing 21 for wire wrap connections to a post portion 68 of fixed contacts 60, 61. The bottom closure 38 also provides a stop for the open position of movable element 79 (FIG. 4), and a recess 102 for the retainer 100 described below.

Figure 4:
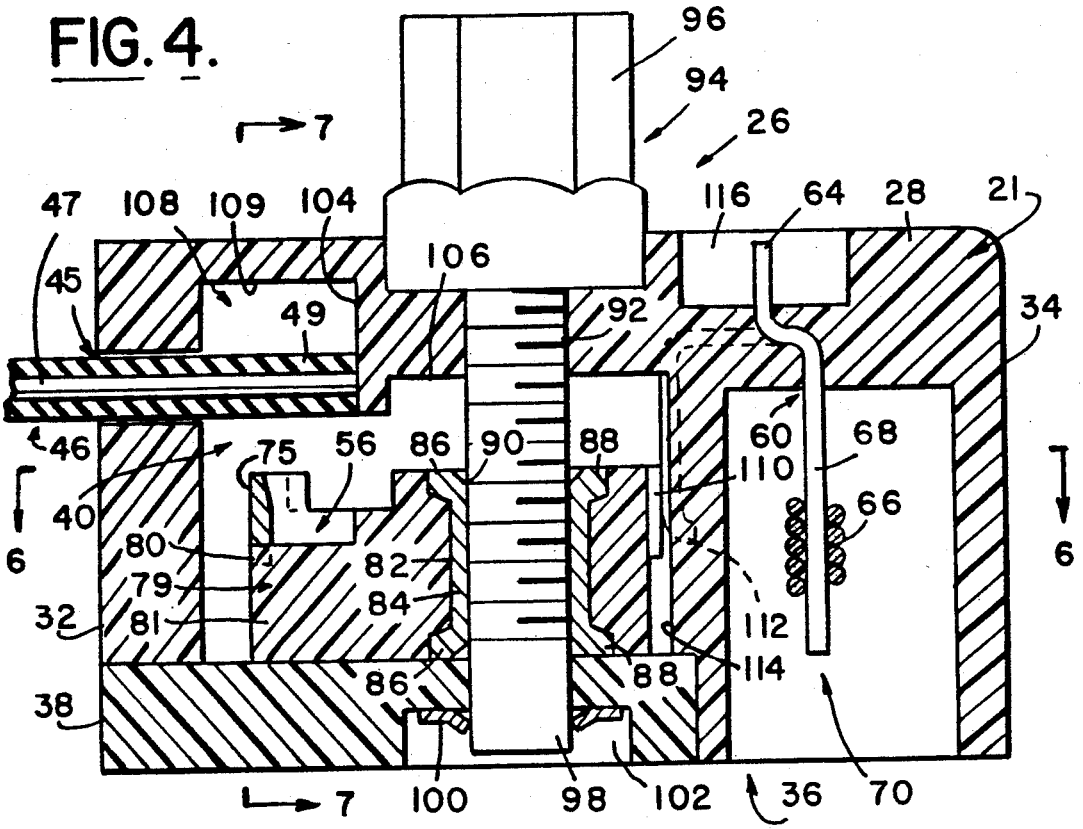
FIG. 4 is a side section view of the connector assembly depicted in FIG. 1 taken along line 4—4 in FIG. 1, showing an insulated conductor of a drop line inserted into one connector of the assembly, the movable contact of that connector in the open position thereof and a conductor wrapped to another contact of that connector.

A pair of spaced inlets 42 and 43 (FIG. 1) in front 32 of housing 21 communicate with a respective cavity 40, and a larger dumbbell shaped inlet 45 in front 32 also communicates with a respective cavity 40 (FIG. 4). An insulated drop line 46 (FIG. 1) comprised of two conductors 47 and 48 insulated by insulation 49 may be inserted into a respective cavity 40 through a respective inlet 45; alternatively, single conductors 50 of lines 51 surrounded by insulation 52 may be inserted into cavity 40 through each of inlets 42 and 43. Inlets 42 and 43 are sized to accept two different insulated conductors 50, and each connector 22-26 is structured to make contact with two insulated conductors 50 per inlet 42, 43 and one drop line 46 per inlet 45, for a total of three pairs of insulated conductors.

Figure 5:
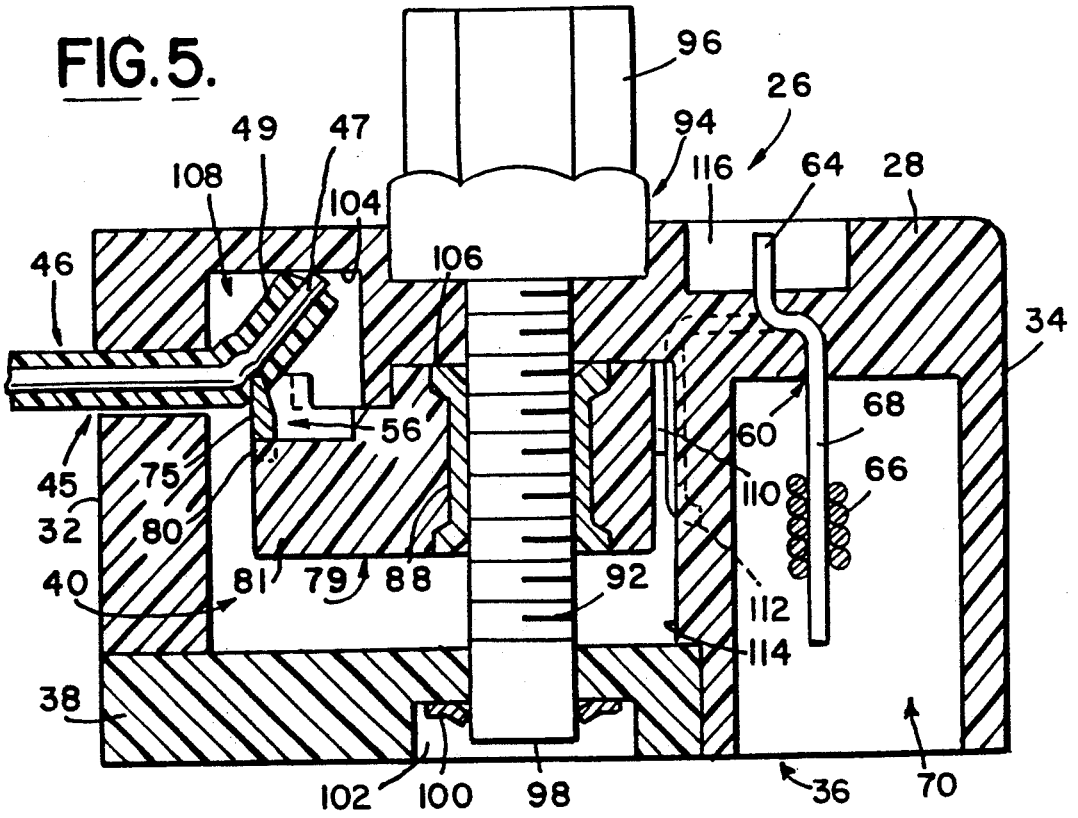
FIG. 5 is view similar to that of FIG. 4 but with the movable contact in the closed position thereof in contact with the insulated conductor of the drop line.
Figure 6:
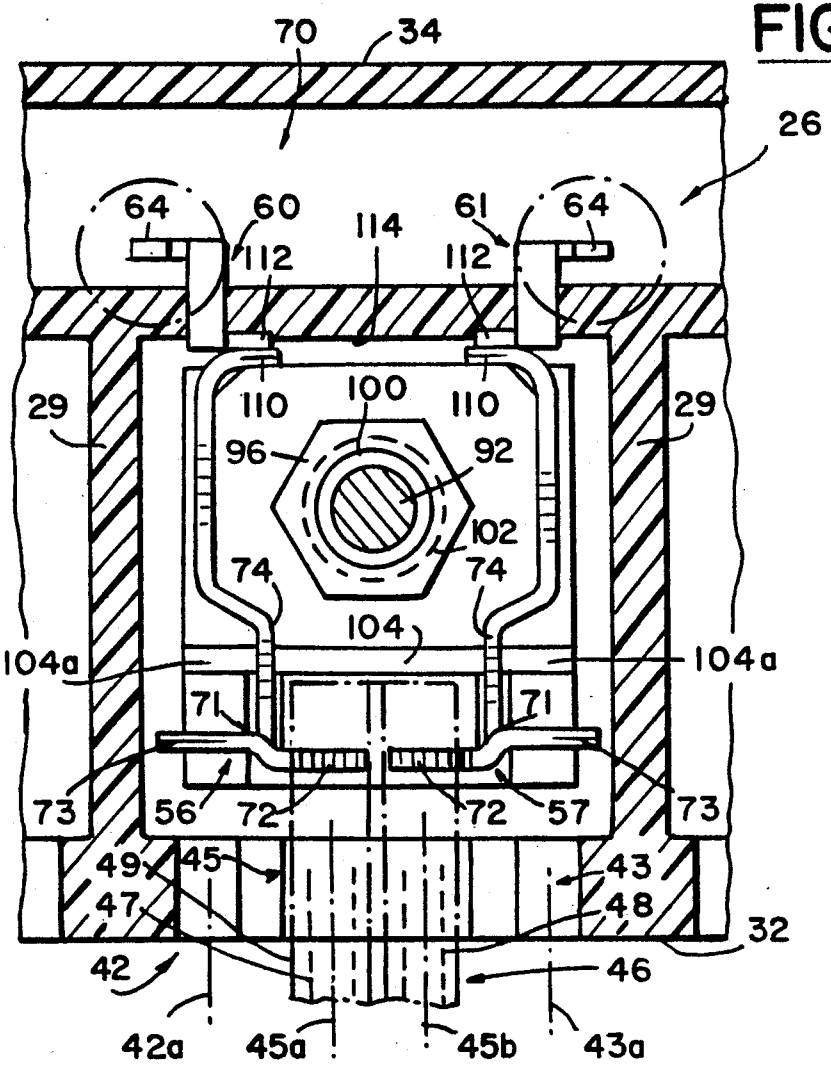
FIG. 6 is a section view of the connector assembly of FIG. 1 taken along line 6—6 in FIG. 4, showing the open position of the movable contact.

Within cavity 40 in each connector 22-26 are disposed two movable contacts 56 and 57 (FIG. 6). Each connector 22-26 also includes two fixed contacts 60 and 61 fixed with respect to cavity 40. Each contact 56, 57 is of single-piece construction extending from the front portion of cavity 40 to the rear portion of cavity 40 where the respective movable contact 56, 57 makes sliding contact with the respective fixed contact 60, 61. A test prong 64 (see also FIGS. 1, 2 and 4) is electrically connected to each fixed contact 60, 61. Movable contacts 56 and 57 when moved to the closed position depicted in FIG. 5 make electrical contact with the respective conductors 47 and 48 of drop line 46 inserted into cavity 40 (connection to conductor 47 being shown in FIG. 5), and/or with respective single conductors 50 of single conductor lines 51 (which are not shown in the drawings to be making contact with a conductor).

A conductor 66 (FIG. 4) may be wrapped ("wire-wrapped") to a post portion 68 of each fixed contact 56, 57 which extends in cavity 70 in the bottom 36 of housing 21. Thus, each connector 22-26 connects conductors 50 of up to four lines 51, and/or conductors 47, 48 of one two-conductor drop line 46 to respective wire-wrapped conductors 66, for a total of up to three pairs of conductors.

Referring to FIGS. 6 and 7, as mentioned above each movable contact 56, 57 extends from the front portion to the rear portion of cavity 40. Each contact 56, 57 is bent at 71 to form a central front portion 72, a side front portion 73 and a rearwardly extending portion 74. Side front portion 73 is formed as a lance bent from the edge of rearwardly extending portion 74 adjacent bend 71.

Central front portion 72 and side front portion 73 of each contact 56, 57 each carries a respective blade portion 75, 76 (FIG. 7).

As depicted in FIG. 6, central and side front portions 72 and 73 of movable contact 56 extend in cavity 40 generally perpendicular to and intersecting the axis 42*a* of inlet 42 and the axis 45*a* of the left portion of inlet 45, respectively; and central and side front portions 72 and 73 of movable contact 57 extend in cavity 4 generally perpendicular to and intersecting the axis 43*a* of inlet 43 and the axis 45*b* of the right portion of inlet 45, respectively. Thus, blade portions 75 intersect axes 45*a* and 45*b* of inlet 45, and blade portions 76 intersect axes 42*a* of inlet 42 and 43*a* of inlet 43.

Movable contacts 56 and 57 are attached to a movable element 79 (FIGS. 4 and 5) by suitable means such as grooves 80 in movable element 79 which receive respective contacts 56, 57 and a waterproof adhesive. Movable element 79 comprises a body portion 81 preferably made of a non-conducting material such as plastic, e.g., Polyester (PBT), which has a bore 82 therethrough in which a threaded insert 84 is engaged. Insert 84 need not be electrically conducting but must be durable and may therefore be made of a strong, inexpensive (compared to brass) metal such as carbon or stainless steel. Body portion 81 of element 79 may be integrally molded to insert 84 to attach the two pieces together. Flanged ends 86 of insert 84 are engaged in annular grooves 88 of bore 82 to prevent separation or relative movement between body portion 81 and insert 84.

Insert 84 has a central threaded bore 90 which is threaded to the shank 92 of a metal bolt 94 whose head 96 protrudes from the top 28 of connector housing 21 so as to be accessible for engagement by a tool such as a wrench. The free unthreaded end 98 of shank 92 is captivated by a retainer 100 such as a push-on clip, fixed in shallow recess 102 in the bottom 36 of housing 21. This retainer 100 along with head 96 keeps bolt 94 in the same relative position in the housing 21 regardless of the position of the movable element 79.

The thread system for insert 84 and bolt 94 is right-handed so that clockwise rotation of bolt 94 causes movable element 79 to move towards bolt head 96 (i.e., upwards in FIG. 4). Thus, a tightening rotation of bolt 94 causes movable element 79 to move upwardly from the open position depicted in FIG. 4 to the closed position depicted in FIG. 5; and a loosening rotation of bolt 94 causes movable element 79 to move downwardly from the closed position of FIG. 5 to the open position of FIG. 4.

FIGS. 4 and 5 show the sequence by which electrical connection is made between the conductor 47 of drop line 46 and movable contact 56. Drop line 46 is inserted into cavity 40 of connector 26 through inlet 45 thereof until it abuts stop 104 as depicted in FIG. 4. Bolt 94 is then tightened (rotated clockwise) to raise movable element 79 until movable element 79 abuts stop 106. As movable element 79 is moved towards conductor 47, blade portion 75 of contact 56 displaces the insulation 49 on conductor 47 and makes contact with conductor 47. During or prior to displacement of insulation 49, or upon blade portion 75 making contact with conductor 47, blade portion 75 moves conductor 47 upwardly against the upper surface 109 of inlet 45, as depicted in FIG. 5. Thereafter, continued movement of blade portion 75 bends conductor 47 upwardly into slot 108 of cavity 40 against wall 109 until upward movement of movable element 79 is stopped by stop 106. During such bending of conductor 47, blade portion 75 tangentially engages conductor 47 and makes electrical contact therewith.

Slot 108 in cavity 40 is sized to allow the end of conductor 47 to be bent before blade portion 75 cuts any substantial distance into conductor 47. As a result, blade portion 75 moves into a tangentially engaging position with respect to conductor 47. Thereby, damage to conductor 47 is substantially avoided. A tangentially-engaging contact of blade portion 75 and bent conductor 47 utilizes a slight spring action of the bent conductor 47 against the blade portion 75 to urge the two into electrical contact. The blade portion 75 thus "rubs" or "wipes" against the conductor to make good electrical contact therewith, even though there may be some relative movement due to different thermal expansions of the different materials over extreme temperature changes. The tangential contact of conductor 47 and blade portion 75 and the slight spring action of conductor 47 accommodate expansion and contraction of blade portion 75, conductor 47 and movable element 79, which have different coefficients of expansion, over a relatively wide temperature range, e.g., at least about −40° F. to 176° F., without loss of contact pressure and electrical contact between blade portion 75 and conductor 47 over many temperature cycles.

As shown in FIG. 7, the two blade portions 75 decreasingly taper in height towards each other, i.e., are angled, to tend to center a drop line 46 that is smaller than the size of dumbbell inlet 45. That blade shape will accommodate the widest range of different dimensional differences in drop lines 46. The working edges of blades 75 and 76 may taper in thickness, i.e. may be angled, as shown in the drawings to improve contact action. An angled contact blade not only pushes through the insulation to make contact with the conductor, but it also tends to slice or wipe through the insulation similar to the action of a blade. The thinner cutting edge of an angled blade requires less force to displace the insulation and therefore reduces the forces acting on both the contacts and on the movable element 79. This allows for a lighter and less expensive movable element, while allowing the remainder of the contact thickness to be adequate to meet the bending and bearing loads. The blade angle may be facing away from the conductor entry to the connector ("back angle"), as in FIGS. 4 and 5, or facing the conductor entry as in FIGS. 8 and 9 ("front angle"). A back angle is preferred because it provides a more consistent wiping action with the conductor than a front angle. Alternatively, the blade edges may be squared (not shown) and still achieve insulation displacement due to the sharp corners of the blade and the thinness of the blade.

Inlet 45 is sized to accommodate insulated drop lines and single conductor connection lines having diameters (including the insulation) within a given range. Conductor 47 depicted in FIGS. 4 and 5 with its insulation 49 is of a diameter in the upper part of the range, and the sequence of FIGS. 4 and 5 illustrates blade portion 75 making contact with conductor 47.

The sequence of making contact of a smaller diameter conductor in the lower part of the conductor size range with blade portion 75 of connector 26 is basically the same as described above with respect to FIGS. 4 and 5 for conductor 47, except that the smaller diameter conductor moves upwardly in inlet 45 a greater distance before bending, the amount of bending is less, and blade portion 75 makes contact with the smaller diameter conductor at more of an angle than it does with a larger diameter conductor 47. However, due to the bending action, the smaller diameter conductor is not damaged and yet good contact is made between blade portion 75 and the smaller diameter conductor.

Electrical contact of blade portion 76 with a conductor 50 inserted in inlets 42 and 43 is made generally as described above for blade portion 75 and conductor 47 inserted in inlet 45.

Since both movable contacts 56 and 57 and their corresponding blade portions 75, 76 are carried by movable element 79 and move together, contact to two conductors 50 or two conductors 47, 48 of a communication pair is made simultaneously using only one actuator, i.e., bolt 94. As described above, it is not necessary to strip the insulation 49, 52 away from the respective conductor to make electrical contact with the conductor. The unstripped conductors are simply inserted into the respective connector through the respective inlet and bolt 94 tightened, which may be done without difficulty by a service technician.

Referring to FIG. 6, rearwardly extending portions 74 of movable contacts 56 and 57 each terminate in an inwardly extending portion 110. Fixed contacts 60 and 61 each include a downwardly extending portion 112 (see also FIGS. 4 and 5) running along the inner rear wall 114 of cavity 40 for a distance corresponding at least to the travel of movable element 79. Although inwardly-extending movable contact portions 110 contact downwardly extending fixed contact portions 112 over the entire length of travel of movable element 79, contact need only be made in the closed position of movable element 79.

Referring to FIGS. 4 and 5, downwardly extending portion 112 of fixed contacts 60 and 61 is connected to post portion 68 and test prong 64 of the respective contact through rear wall 114 of cavity 40. This is accomplished preferably by integrally molding housing 21 to fixed contacts 60 and 61. Post portion 68 of each fixed contact 60 and 61 is accessible in deep recess 70 for receiving a conductor 66 wire-wrapped thereto in known manner. Test prong 64 extends in a recess 116 in housing top 28, but does not protrude beyond the outer surface of top 28. As a result, accidental contact with the test prong is avoided, thereby providing the so-called quiet front feature for the test prongs. Recess 116 and test prong 64 may accommodate various alligator clips or test probes, and in the preferred embodiment recess 116 is waterproofed.

Cavity 40 of each of connectors 22–26 is sealed liquid-tight except for inlets 42, 43 and 45. Movable element 79 is sized and disposed in cavity 40 such that a waterproofing or sealing compound such as silicone grease in cavity 40 may move past movable element 79 as the movable element is moved in cavity 40. The advantage of this arrangement is that cavity 40 has a constant volume at all times such that after being filled with compound (either before or after a connection is made, i.e., while the movable element is in the open or closed position), the cavity will retain and not expel the compound when a conductor is disconnected or connected. This allows a single charge of a sealing or waterproofing compound to be used for multiple connect-/disconnect cycles without having to replenish the compound. Also, with the arrangement described above, it is not necessary to provide a separate space for the compound to move into and out of while retaining the compound for multiple connect/disconnect cycles. With a suitable waterproofing compound, assembly 20 may maintain electrical connection continuity even if the entire assembly is submerged in salt water.

Figure 1:
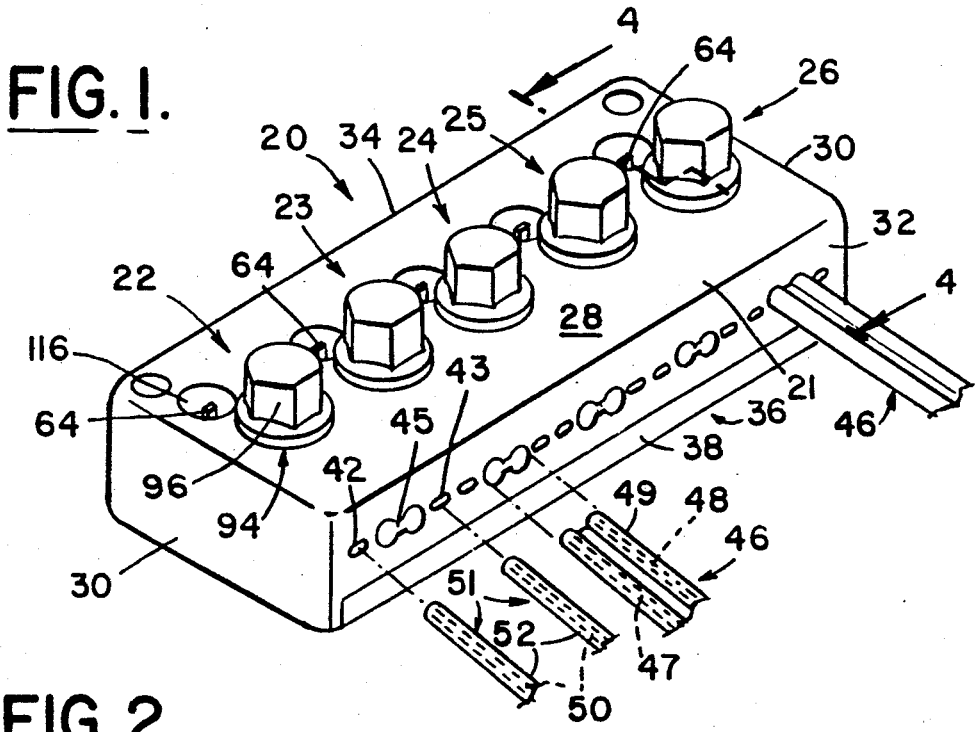
FIG. 1 is a perspective top view of a connector assembly according to the invention incorporating a plurality of connectors according to the invention, showing insertion into the assembly of insulated two conductor drop lines and insulated single conductor lines.
Figure 2:
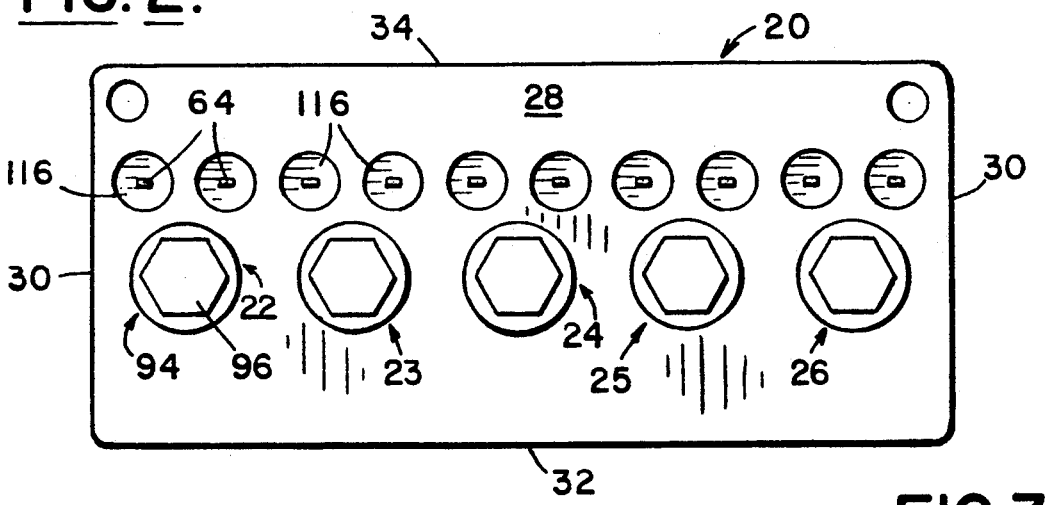
FIG. 2 is a top view of the connector assembly depicted in FIG. 1.
Figure 3:
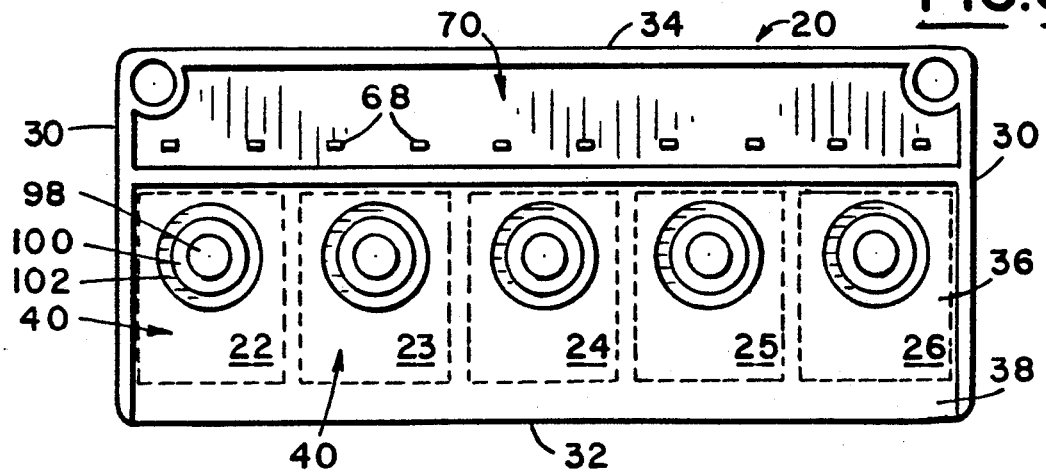
FIG. 3 is a bottom view of the connector assembly depicted in FIG. 1.
Figure 8:
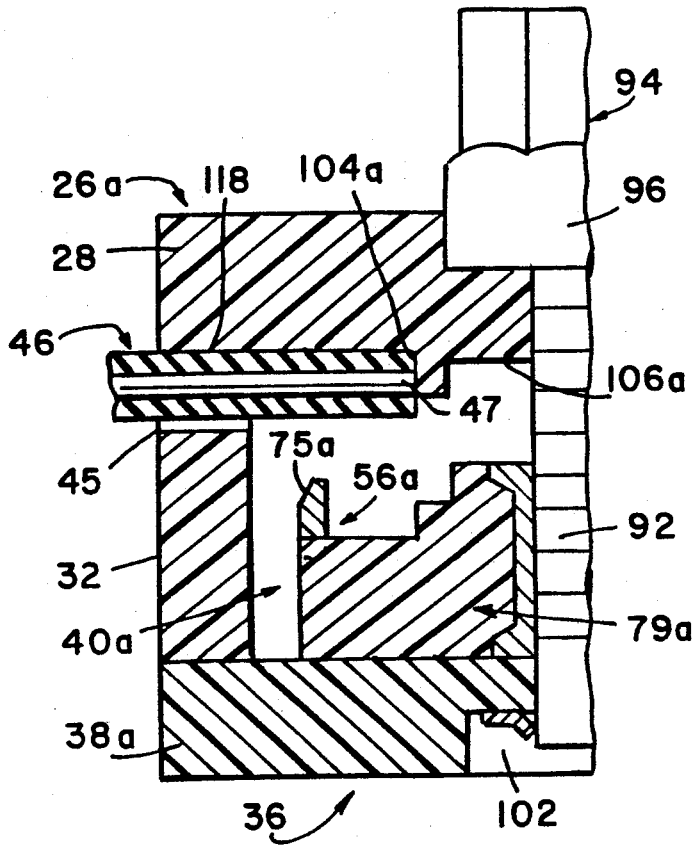
FIG. 8 is a side section view similar to that of FIG. 4 of a connector assembly according to another embodiment of the invention, showing the movable contact of one of the connectors thereof in the open position.
Figure 9:
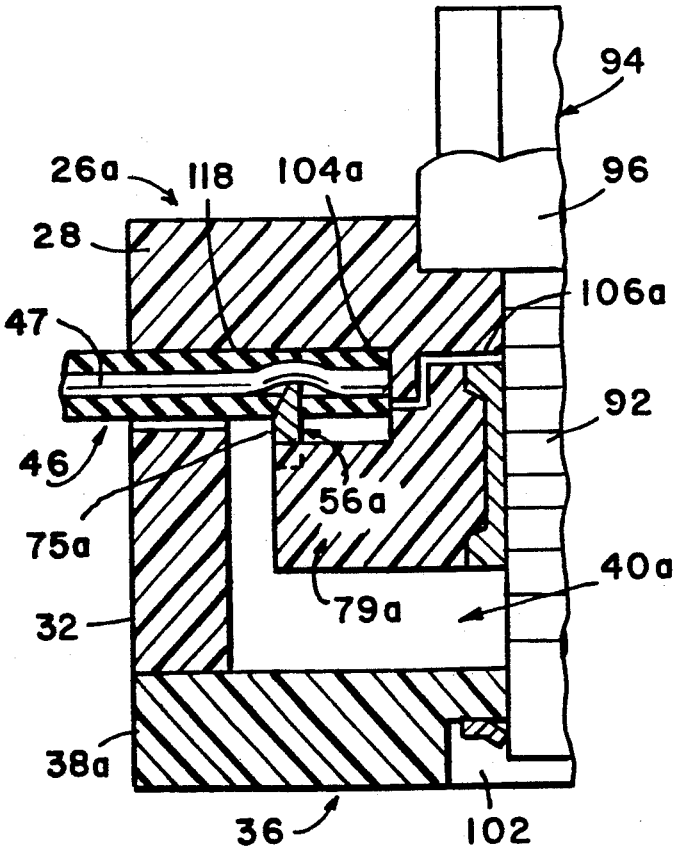
FIG. 9 is a side section view similar to that of FIG. 8 of the connector assembly depicted in FIG. 8 showing the movable contact in the closed position thereof in contact with an insulated conductor of a drop line.

Referring next to FIGS. 8 and 9, an alternate embodiment of a connector **26*a* for an assembly similar to assembly 20 of FIG. 1 is depicted. Connector 26*a* is similar to connector 26 except for the configuration of cavity 40*a* thereof and movable contacts 56*a*. Cavity 40*a* does not include a slot 108. As a result, the free end of a conductor inserted into cavity 40*a* say through inlet 45 does not bend in response to upward movement of movable element 80*a*. Instead, the free end of the conductor is restrained from bending by the top wall 118 of cavity 40*a*, and the edge of blade portion 75*a* perpendicularly cuts into conductor 47. Compared to the embodiment of FIGS. 1–7, the embodiment of FIGS. 8 and 9 is not considered to be able to accommodate as wide a range of conductor sizes without damage and without loss of contact pressure between the conductor and the contact blade portion over as wide a temperature range and/or as large a number of temperature cycles. This embodiment requires that the contact blade portions 75*a* pierce the insulation 49 and make contact with the conductor 47 in a substantially perpendicular manner. As the final location of the blade portion 75*a* is fixed by the distance from blade portion 75*a* to surface 106*a* of top 28, this distance is chosen to insure electrical contact with all varieties of drop lines 46. Accordingly, the insulation 49 that is in contact with wall 118 must be deformed by the conductor 47 a varying amount to compensate for the drop line differences. This also means that the contact pressure between the conductor 47 and the contact blade portion 75*a* is dependent upon the compressive strength of the insulation 49 and is not a constant. Under thermal cycling conditions the distance between blade portion 75*a* and surface 106*a* may change slightly and the maintenance of adequate contact pressure depends upon the elastic recovery properties of the insulation 49**. With the proper choices of materials for the contacts and the block components, the dimensional variations can be minimized and adequate electrical contact maintained.

Thus, contact between the movable contact blades **75*a* (and 75 and 76) and the conductors depends to a limited extent upon the compressive strength of the plastic body 21. The blade pushes through the insulation and forces the conductor against both its own insulation, which is normally quite soft and of low compressive strength, and then against the plastic wall 109, 118 of the plastic body 21. While the plastic wall 109, 118 is relatively strong, plastic under high compressive stresses at elevated temperatures tends to creep or move and thereby may relieve some of the contact pressure. To improve the electrical contact of a conductor with movable blade contact 75, 75*a*, 76, a metallic element 130, 130*a* (FIGS. 10–12) is preferably embedded in the plastic wall 109, 118 of body portion 21 within a respective cavity 40, 40*a*** opposite a respective blade contact.

Arranging the blade 75 to contact the conductor at an angle (FIGS. 4 and 5) so that the blade is tangential to the conductor greatly improves the connection. In addition or alternatively, supporting the conductor by a metallic element **130, 130*a* (FIGS. 10–12) embedded in the plastic body wall portion 109, 118** allows for constant contact under all conditions.

Referring to FIGS. 10 and 11, metallic element 130 is connected to fixed contact 60 at the rear of the respective connector **26*b* and extends forwardly through plastic body 21 into cavity 40 adjacent wall 109 therein, and along the interior of connector front 32. As depicted in FIG. 11, the metallic elements 130 are relatively wide and occupy a substantial portion of the wall 109 of cavity 40 above contacts 75 and 76. This ensures that a bent conductor end will contact a metallic element 130 and provide a temperature stable support surface. Each metallic element 130 not only provides support for a conductor, but also provides a redundant current path to the fixed contact 60 on the side thereof away from the blade contact 75, 76. Thus, a conductor 47 may make electrical contact with fixed contact 60 via a blade contact 75, 76, or via a metallic element 130** as follows. The tip of a conductor may contact a metallic element, or the insulation may be displaced under action of a movable contact, so as to bring the conductor in contact with the metallic element.

Metallic elements 130 are made of the same material as fixed contact 60 and form a unitary, one piece part therewith, or may be connected thereto.

Figure 12:
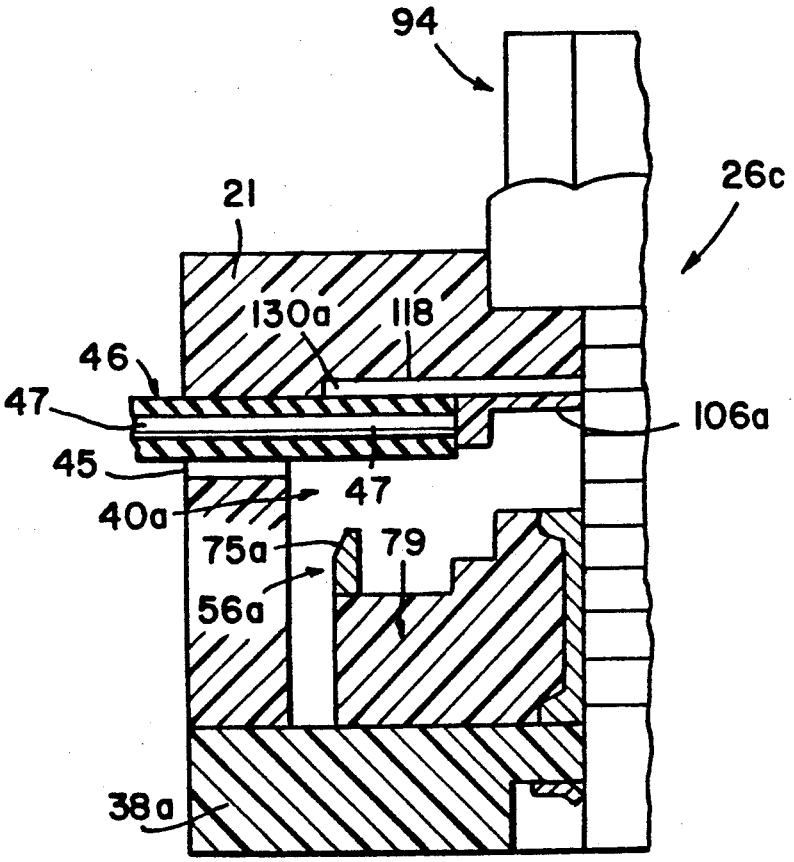
FIG. 12 is a side section view similar to that of FIG. 8 of a connector assembly according to still another embodiment of the invention.

FIG. 12 shows a metallic element 130*a* in the connector embodiment of FIGS. 8 and 9.

The embodiments of FIGS. 10–12 are preferred over the embodiments of FIGS. 4–5 and 8–9 because a more consistent contact may be obtained over relatively wide temperature ranges.

The drawings show a connector assembly 20 with five connectors 22–26. However, connector assemblies according to the invention may include one or any number of connectors. If desired, the connector assembly may be expanded to include additional connectors disposed along side of or above (or below) connectors 22–26. When placed above or below connectors 22–26, housing 21 is increased in height to accommodate a double (or more) layer of movable members 79 actuated by a common, longer bolt. If such connectors are to be completely isolated from each other, then the test prongs and wire wrap posts of the fixed contacts may be made accessible in any convenient matter.

Protection by Letters Patent of this invention in all its aspects as the same are set forth in the appended claims is sought to the greatest extent that the prior art allows.

I claim as my invention:

1. An electrical connector comprising:

a housing defining a cavity therein;

an inlet in said housing to said cavity through which an electrical conductor may be inserted into said cavity;

a first electrical contact disposed in said cavity movable between an open position in which an electrical conductor may be inserted into said cavity adjacent said first contact and a closed position in which said first contact engages and makes electrical contact with said electrical conductor inserted into said cavity;

means actuatable from the exterior of said housing for moving said first contact between said open and closed positions, and a second contact fixed with respect to said cavity and in electrical contact with said first contact at least in said closed position of said first contact, whereby an electrical connection may be made between said conductor and said second contact.

2. The connector of claim 1 wherein said connector is constructed such that said first contact makes electrical contact with an unstripped insulated conductor.

3. An electrical connector comprising:

a housing defining a cavity therein;

an inlet in said housing to said cavity through which an electrical conductor may be inserted into said cavity;

movable contact means disposed in said cavity comprising a movable element and a first electrical contact, said movable element being movable between an open position in which an electrical conductor may be inserted into said cavity adjacent said first contact and a closed position in which said first contact makes electrical contact with said electrical conductor inserted into said cavity;

means actuatable from the exterior of said housing for moving said movable element between said open and closed positions, and a second contact fixed with respect to said cavity in electrical contact with said first contact at least in said closed position of said movable element, whereby an electrical connection may be made between said conductor and said second contact;

said cavity being closed except for said inlet such that said cavity may receive and retain a high viscosity, substantially liquid substance therein for protecting the connection of said conductor to said first contact from adverse environmental conditions, and said second contact including a portion outside of said cavity for connection to a conductor or circuit element or the like.

4. The connector of claim 3 wherein the volume of said cavity available to contain said liquid substance is substantially the same for all positions of said movable element in said cavity.

5. The connector of claim 4 wherein said connector is constructed such that said first contact makes electrical contact with an unstripped insulated conductor.

6. An electrical connector comprising:

a housing;

movable contact means in said housing comprising a movable element and a first electrical contact, said movable element being movable between an open position in which an electrical conductor may be inserted into said housing adjacent said first contact and a closed condition in which said first contact makes electrical contact with said electrical conductor inserted into said housing, there being space in said housing adjacent said first contact such that said conductor may be moved within said space when said movable element is moved from said open to said closed position and such that said first contact tangentially makes contact with said conductor;

means actuatable from the exterior of said housing for moving said first contact between said open and closed positions, and a second contact fixed with respect to said housing in electrical contact with said first contact at least in said closed position of said movable element, whereby an electrical connection may be made between said conductor and said second contact.

7. The connector of claim 6 wherein said space is such that movement of said conductor within said space enables conductors having a size within a range of sizes to be engaged by said first contact without damaging said conductor.

8. The connector of claim 6 wherein said connector is constructed such that said first contact makes electrical contact with an unstripped insulated conductor.

9. The connector of claim 6 wherein said housing defines a cavity in which said movable contact means are disposed, said space being in said cavity adjacent said movable element, there being an inlet in said housing to said cavity through which said electrical conductor may be introduced into said cavity.

10. The connector of claim 9 wherein said cavity is closed except for said inlet such that said cavity may receive and retain a high viscosity, substantially liquid substance therein for protecting the connection of said conductor to said first contact from adverse environmental conditions, said second contact including a portion outside of said cavity for connection to a conductor, circuit element or the like.

11. The connector of claim 10 wherein the volume of said cavity available to contain said liquid substance is substantially the same for all positions of said movable element in said cavity.

12. An electrical connector comprising:

a housing defining a cavity;

an inlet to said cavity through which an electrical conductor with its surrounding insulation surrounded by insulation may be introduced into said cavity;

a first electrical contact disposed in said cavity movable between an open position in which an electrical conductor with its surrounding insulation ma be inserted into said cavity adjacent said first contact and a closed position in which said first contact displaces said insulation and engages and makes electrical contact with said electrical conductor inserted into said cavity, there being space in said cavity adjacent said first contact to accommodate conductors and their surrounding insulation having a size within a given range of sizes such that at least the respective conductor thereof may be moved within said space when said first contact is moved from said open to said closed position, movement at least of said respective conductor within said space enabling said respective conductor to be engaged by said first contact without damaging said respective conductor;

means for moving said first contact between said open and closed positions, and a second contact fixed with respect to said cavity in contact with said first contact at least in said closed position of said movable contact, whereby an electrical connection may be made between said conductor and said second contact.

13. The connector of claim 12 wherein said cavity is closed except for said inlet such that said cavity may receive and retain a high viscosity, substantially liquid substance therein for protecting the connection of said electrical conductor to said first contact from adverse environmental conditions, said second contact including a portion outside of said cavity for connection to a conductor, circuit element or the like.

14. The connector of claim 13 wherein the volume of said cavity available to contain said liquid substance is substantially the same for all positions of said movable element in said cavity.

15. An electrical connector comprising:

a housing;

a plurality of movable electrical contacts in said housing movable between an open position in which a respective electrical conductor may be inserted into said housing adjacent a respective contact and a closed position in which a respective contact engages and makes electrical contact with a respective electrical conductor inserted into said housing;

means for moving said movable contacts together between said open and closed positions, and a plurality of fixed contacts fixed with respect to said housing, a movable contact being in electrical contact with a fixed contact at least in said closed position, whereby an electrical connection may be made between a respective conductor and a respective fixed contact;

said connector being constructed to make electrical contact between at least two of said conductors and two respective movable contacts at the same time when said movable contacts are moved from said open to said closed position.

16. The connector of claim 15 wherein said means for moving is electrically insulated at all times from said movable contacts.

17. The connector of claim 15 wherein said connector is constructed such that said movable contacts make electrical contact with unstripped insulated conductors.

18. The connector of claim 15 wherein said housing defines a cavity in which at least two of said movable contacts are disposed, there being at least one inlet in said housing to said cavity through which at least two electrical conductors may be introduced into said cavity.

19. The connector of claim 18 wherein said cavity is closed except for said at least one inlet such that said cavity may receive and retain a high viscosity, substantially liquid substance therein for protecting the connection of said at least two conductors to said at least two contacts from adverse environmental conditions, at least two of said fixed contacts each including a portion outside of said cavity for connection to a respective conductor, circuit element or the like.

20. The connector of claim 19 wherein the volume of said cavity available to contain said liquid substance is substantially the same for all positions of said at least movable contacts in said cavity.

21. An electrical connector comprising:

a housing;

movable contact means disposed in said housing comprising a movable element carrying a plurality of movable electrical contacts which are moved together in accordance with movement of said movable element, said movable element being movable between an open position in which a respective electrical conductor may be inserted into said housing adjacent a respective movable contact and a closed position in which a respective movable contact engages and makes electrical contact with a respective conductor inserted into said housing;

means for moving said movable element between said open and closed positions, and a plurality of fixed contacts fixed with respect to said housing, a movable contact being in electrical contact with a fixed contact at least in said closed position, whereby an electrical connection may be made between a respective conductor and a respective fixed contact;

said connector being constructed to make electrical contact between at least two of said conductors and two respective movable contacts at the same time when said movable contacts are moved from said open to said closed position.

22. The connector of claim 21 wherein said means for moving is electrically insulated at all times from said movable contacts.

23. The connector of claim 21 wherein said connector is constructed such that said movable contacts make electrical contact with unstripped insulated conductors.

24. The connector of claim 21 wherein said housing defines a cavity in which at least two of said movable contacts are disposed, there being at least one inlet in said housing to said cavity through which at least two electrical conductors may be introduced into said cavity.

25. The connector of claim 24 wherein said cavity is closed except for said at least one inlet such that said cavity may receive and retain a high viscosity, substantially liquid substance therein for protecting the connection of said at least two conductors to said at least two contacts from adverse environmental conditions, at least two of said fixed contacts each including a portion outside of said cavity for connection to a respective conductor, circuit element or the like.

26. The connector of claim 25 wherein the volume of said cavity available to contain said liquid substance is substantially the same for all positions of said at least two movable contacts in said cavity.

27. The connector of claim 25 wherein said fixed contacts include a portion extending into said cavity opposite said movable contact positioned so that a conductor in the closed positioned is between a movable contact and a said fixed contact portion.

28. An electrical connector comprising:

a housing;

first and second inlets in said housing through which first and second relatively widely spaced conductors, respectively, may be introduced into said housing and a third inlet to said housing through which first and second relatively closely spaced conductors may be introduced into said housing;

movable contact means disposed in said housing comprising a movable element carrying a plurality of movable electrical contacts which are moved together in accordance with movement of said movable element, said movable element being movable between an open position in which a respective electrical conductor may be inserted into said housing through a respective inlet or inlets adjacent a respective movable contact, and a closed position in which a respective movable contact engages and makes electrical contact with a respective electrical conductor inserted into said housing;

means for moving said movable contact between said open and closed positions, and a plurality of fixed contacts fixed with respect to said housing, a movable contact being in electrical contact with a fixed contact at least in said closed position, whereby an electrical connection may be made between a respective conductor and a respective fixed contact.

29. The connector of claim 28 wherein said means for moving is electrically insulated at all times from said movable contacts.

30. The connector of claim 28 wherein said connector is constructed such that said movable contacts make electrical contact with unstripped insulated conductors.

31. The connector of claim 28 wherein said housing defines a cavity in which at least two of said movable contacts are disposed, said first, second and third inlets in said housing communicating with said cavity.

32. The connector of claim 31 wherein said cavity is closed except for said inlets such that said cavity may receive and retain a high viscosity, substantially liquid substance therein for protecting the connection of said at least two conductors to said at least two contacts from adverse environmental conditions, at least two of said fixed contacts each including a portion outside of said cavity for connection to a respective conductor, circuit element or the like.

33. The connector of claim 32 wherein the volume of said cavity available to contain said liquid substance is substantially the same for all positions of said at least two movable contacts in said cavity.

34. An electrical connector comprising:

a housing defining a cavity therein;

an inlet in said housing to said cavity through which an electrical conductor may be introduced into said cavity;

movable contact means disposed in said cavity comprising a movable element and a first electrical contact, said movable element being movable between an open position in which an electrical conductor may be inserted into said cavity adjacent said first contact and a closed position in which said first contact makes electrical contact with said electrical conductor inserted into said cavity;

means for moving said movable element between said open and closed positions, and a second contact fixed with respect to said cavity in electrical contact with said first contact at least in said closed position of said movable element, whereby an electrical connection may be made between said conductor and said second contact;

said second contact including or being coupled to a test prong outside of said cavity, said housing having a recess therein, said prong being disposed in said recess and not protruding from said housing.

35. An electrical connector comprising:

a housing defining a plurality of cavities therein, said plurality of cavities being closed by a common closure element;

an inlet in said housing to each said cavity through which an electrical connector may be introduced into each said cavity;

movable contact means disposed in each said cavity comprising a movable element and a first electrical contact, each said movable element being movable between an open position in which an electrical conductor may be inserted into said cavity adjacent a respective first contact and a closed position in which a respective first contact makes electrical contact with a respective electrical conductor inserted into said cavity;

means for moving respective movable elements between said open and closed positions, and a second contact fixed with respect to each said cavity in electrical contact with a respective first contact at least in said closed position of a respective movable element, whereby an electrical connection may be made between said conductor and said second contact.

* * * * *

UNITED STATES PATENT AND TRADEMARK OFFICE

CERTIFICATE OF CORRECTION

PATENT NO. : 5,069,637

DATED : December 3, 1991

INVENTOR(S) : Richard C. Baubles

It is certified that error appears in the above-identified patent and that said Letters Patent is hereby corrected as shown below:

Col. 1, line 29: after "Debruycker" add --et al.--.

Col. 2, line 17: for "edge" (first occurrence in line) read --edges--.

Col. 5, line 43: between "is" and "view" insert --a--.

Col. 7, line 9: for "4" read --40--.

Col. 11, line 39: for "matter" read --manner--.

Col. 13, line 22 (Claim 12, line 4): cancel "with its surrounding insulation".

Col. 13, line 27 (Claim 12, line 9) for "ma" read --may--.

Col. 15, line 29 (Claim 27, line 4) after "closed" for "positioned" read --position--.

Signed and Sealed this

Twenty-seventh Day of April, 1993

*Attest:*

MICHAEL K. KIRK

*Attesting Officer*

*Acting Commissioner of Patents and Trademarks*